United States Patent [19]

Vincent

[11] Patent Number: 4,882,792

[45] Date of Patent: Nov. 28, 1989

[54] AUTO-DUMP FLOW CONTROLLER

[76] Inventor: Ray T. Vincent, 3832 Sunbeam Dr., Los Angeles, Calif. 90065

[21] Appl. No.: 179,875

[22] Filed: Apr. 11, 1988

[51] Int. Cl.[4] ..... E03D 1/00

[52] U.S. Cl. ..... 4/323; 4/321; 134/98; 134/164 R

[58] Field of Search ..... 4/321, 322, 323; 137/15, 240, 238, 237; 134/98, 169 R

[56] References Cited

U.S. PATENT DOCUMENTS

| | | | |
|---|---|---|---|
| 737,941 | 9/1903 | Leithauser . | |
| 1,458,816 | 6/1928 | Fyke et al. . | |
| 2,838,765 | 8/1955 | Hosking | 4/41 |
| 3,447,777 | 6/1969 | Carlson | 251/144 |
| 3,448,745 | 6/1969 | Seeley | 134/169 R |
| 3,501,778 | 3/1970 | Minniear et al. | 4/321 |
| 3,579,651 | 5/1971 | Russo | 4/322 |
| 3,677,294 | 7/1972 | Gibbs et al. | 137/572 |
| 4,304,015 | 12/1981 | Hubatka | 4/407 |
| 4,332,041 | 6/1982 | Kristoffersen | 4/323 |
| 4,338,689 | 7/1982 | Zieg | 4/378 |
| 4,527,295 | 7/1985 | Lacore | 4/323 |
| 4,584,726 | 4/1986 | Grills et al. | 4/378 |

OTHER PUBLICATIONS

PCT Application Int. publication No. WO79/00826, Intern. publication date 10/18/79, assigned to Norlin.

*Primary Examiner*—Henry J. Recla
*Assistant Examiner*—Edward C. Donovan
*Attorney, Agent, or Firm*—Fulwider, Patton, Rieber, Lee & Utecht

[57] ABSTRACT

The automatic hydraulic valve control apparatus is intended for use in combination with a lavatory waste tank of a vehicle, such as an airplane. The waste tank includes a drain, a rinsing valve, and a fluid pressure charging inlet. The hydraulic valve control apparatus includes a drain control valve biased to be in an open position, a drain valve responsive to opening of the drain control valve and fluid pressure in line, a rinse valve control including a timing circuit to control the amount of pre-charging of the tank once the drain closes, and a drain control valve actuator including a timing circuit operating to close the drain after a desired period of time. An anti-siphon circuit is also provided to allow a given amount of gas to enter the charging line once rinsing and pre-charging of the waste tank are completed.

13 Claims, 5 Drawing Sheets

AUTO-DUMP FLOW CONTROLLER

BACKGROUND OF THE INVENTION

1. Field of the Invention:

This invention relates generally to waste tank servicing assemblies, and more particularly relates to an automatic hydraulic valve control apparatus for use in combination with a lavatory waste tank adapted to be installed in a vehicle, such as an aircraft.

2. Description of the Prior Art:

Most aircraft lavatory systems include a waste tank which may be used with a recirculating toilet system. The tank retains human wastes, and is drained by service personnel on the ground. During this process, service personnel connect the tank with a fluid pressure line for providing a rinsing fluid while the tank is draining, and for providing a given amount of fluid as a pre-charge of the tank. The pre-charge is necessary for operation of a recirculating toilet system. In most conventional systems, the service personnel normally operate a drain valve separately from the fluid pressure charging of the tank, so that occasionally the service personnel allow the tank to rinse and drain for excessive periods of time, wasting the cleaning or other fluid being used. After the drain valve is closed, fluid is to be allowed to continue to flow for a short period of time to provide the precharge volume of fluid for the tank. Service personnel occasionally allow the fluid charging to continue until the tank overflows, causing corrosion in the flooded portions of the aircraft.

Various electronically controlled automatic toilet tank servicing systems have been devised, utilizing electronically timed solenoid valves for controlling draining time and pre-charge time. However, such systems are not generally completely automatic, and require supervision by service personnel to manually open a stuck drain valve to prevent overflow of the tank. Such systems also typically include a flow meter, electronic counters, and battery packs to power the electronic system. Another type of automatic toilet tank servicing system provides a pre-charge tank which is filled when the system is charged with fluid pressure, opening the drain valve and rinsing the tank. When the fill line is depressurized, the drain valve is closed by the operation of the hydraulic system, and the pre-charged tank then discharges its contents to the tank rinse line thereby providing the tank with a given amount of pre-charge fluid. Such a system is shown in U.S. Pat. No. 4,584,726, but is also not completely automatic, requiring supervision by a technician to depressurize the system to commence the pre-charge of the tank, so that it is possible for a technician to rinse the tank for an excessive period of time. The system also requires close supervision by a technician to manually open the drain valve if it is stuck, in order to avoid a potential overflow of the system. In addition, the pre-charge tank of this system occupies an additional volume of space which cannot be accommodated in the lavatories of most passenger aircraft. Finally, the charging line of the tank may also siphon fluid from the system, further wasting fluid, and adding to the possibility of corrosion. Fill lines of conventional systems generally have check valves to prevent siphoning. These check valves also typically have small vent holes to allow draining of the fill lines following servicing on the ground, in order to prevent freezing of fluid in the lines at high altitudes. However, these vent holes effectively defeat the purpose of the check valve at the low atmospheric pressures of high altitude flight.

Ideally, an automatic toilet tank system should not require close supervision of the drain valve to insure that the system does not overflow or of the period of time in which the tank is rinsing while it is being service. Ideally, such a system should operate automatically to cycle through the draining, rinsing and pre-charging of the tank once the technician connects the fluid pressure charging line to the fill line of the system. It would also be ideal for such a system to prevent siphoning of fluid from the the tank through the fill lines of the system when the fill line port is exposed to high vacuum at an aircraft's high cruise altitudes.

SUMMARY OF THE INVENTION

The present invention provides an automatic hydraulic valve control apparatus for use in combination with a lavatory waste tank, which is entirely automatic in its operation, not requiring close supervision by service personnel of the draining, rinsing or pre-charging of the tank. The apparatus includes fluid-isolated hydraulic timing circuits and a piloted valve controlling the draining, rinsing and pre-charging operation. The system further includes an automatic anti-siphon circuit which will initially admit air to allow draining of the fill lines immediately after servicing. The same circuit will automatically close to prevent siphoning of fluid and cabin by the low atmosphere pressure at an aircraft's cruising altitude.

Briefly and in general terms, an automatic hydraulic valve control apparatus according to the invention, for use in combination with a lavatory waste tank in a vehicle, such as aircraft, the tank having a drain, means for rinsing the tank, a rinse valve, and a fluid pressure charging inlet, comprises a drain control valve in fluid communication with the inlet, having an open position and a closed position, and biased to be in an open position; a drain valve in fluid communication with the drain control valve to open the drain when fluid pressure is introduced into the system into the charging inlet and the drain control valve is in the open position, with the drain valve being biased to be in a closed position; a hydraulic rinse valve control circuit for opening the rinse valve when the drain valve is in the open position, and closing the rinse valve when the drain valve is in the closed position, and including a hydraulic timing circuit for delaying the closing of the rinse valve a predetermined period of time after closure of the drain valve; and a drain control actuator which responds to fluid pressure in the system to close the drain control valve a predetermined period of time after the charging of fluid pressure in the pressure charging inlet.

In a preferred embodiment, the hydraulic valve control apparatus also includes an anti-siphon valve in fluid communication with the pressure charging inlet to permit the entry of a predetermined amount of air into the fluid inlet line as soon as that line is depressurized at the end of each servicing. The rinse valve control preferably includes a closed hydraulic fluid loop, and there is also preferably a closed hydraulic fluid circuit in the drain control actuator A flow regulator is provided in the line to the rinse valve, in the preferred mode, and a pressure reducer is also preferably provided in the line to the timing circuit for the drain control valve actuator. The anti-siphon valve also preferably includes a line with an inlet open to the atmosphere, with a timing mechanism to allow the introduction of air into the system for a short period of time after depressurization of the fluid pressure charging inlet.

Other aspects and advantages of the invention will become apparent from the following detailed description, and the accompanying drawings, illustrating by way of example the features of the invention.

DETAILED DESCRIPTION OF THE INVENTION

Figure 1:
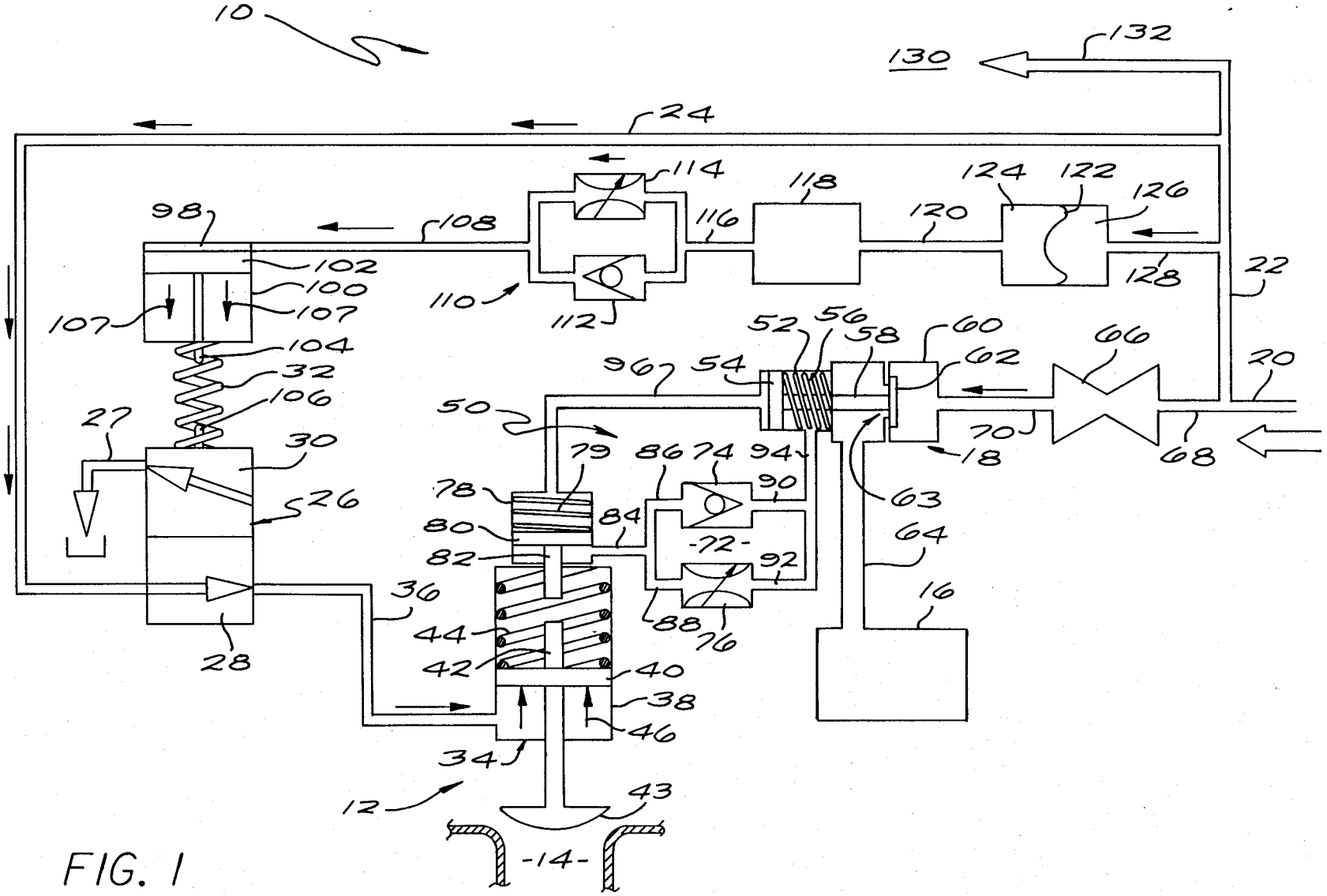
FIG. 1 is a schematic diagram of the valve control apparatus while the tank is draining.

As is shown in.the drawings for purposes of illustration, the invention is embodied in an automatic hydraulic valve control apparatus for use in combination with a lavatory waste tank for use in a vehicle, such as an airplane, with the tank having a drain, a rinsing mechanism, and a rinse valve and fluid pressure charging inlet, comprising a drain control valve means in fluid communication with the inlet, biased to be in an open position; drain valve means include communication with the drain control valve operated to open the drain when fluid pressure is introduced to the pressure charging inlet and the drain control valve is in the open position, the drain valve being biased to be in a closed position; hydraulic rinse valve control means for opening the rinse valve when the drain valve is in the open position, and closing the rinse valve when the drain valve is in the closed position, including a hydraulic timing means to delay the closing of the rinse valve a predetermined period of time, to allow a given amount of pre-charging of fluid in the tank; and drain control actuator means for closing the drain control valve following a predetermined period of time after charging the fluid pressure in the pressure charging inlet.

The apparatus is completely automatic, being hydraulically operated by the charging of fluid pressure in the system, so that service personnel need only connect the fluid pressure charging apparatus to the valve control apparatus for a sufficient period of time for the system to cycle through draining, rinsing and pre-charging. Rinsing of the tank is contingent upon the drain valve opening, so that there is no danger of overflow of the tank; and the timing mechanisms provided allow the system to utilize only as much fluid as is necessary for rinsing and pre-charging of the tank. The anti-siphon circuit of the apparatus further automatically opens to introduce air into the lines of the system to allow the fill lines to drain after each servicing cycle, and automatically closes after a short period of time to prevent siphoning of fluid and air from the system. Operation of the hydraulic timing mechanisms are also completely protected from corrosion or contamination from the pressure charging fluid by isolation of fluid in the timing circuits by utilization of hydraulically isolated fluid circuits.

In accordance with the invention, there is provided an automatic hydraulic valve control apparatus for use in combination with a lavatory waste tank for use in a vehicle, the tank having a drain, means for rinsing the tank, a rinse valve for controlling the means for rinsing, and a fluid pressure charging inlet for said valve control apparatus, the apparatus comprising drain control valve means in fluid communication with said inlet, having an open position and a closed position, and biased to be in an open position; drain valve means in fluid communication with said drain control valve operative to open said drain when fluid pressure is introduced through said charging inlet and said drain control valve is in the open position, said drain valve means having an open position and a closed position, and biased to be in a closed position; hydraulic rinse valve control means for opening and closing said rinse valve responsive to said drain valve means so as to open said rinse valve when said drain valve means approaches the open position, said rinse valve control means biased to close said rinse valve when said drain valve means is in the closed position, and including hydraulic timing means to delay the closing of said rinse valve a predetermined period of time; and drain control valve actuator means responsive to fluid pressure from said inlet to close said drain control valve a second predetermined period of time after charging of fluid pressure in said pressure charging inlet.

As is shown in the drawings, a hydraulic valve control apparatus 10 is provided in a waste tank 12, having a drain 14, and a rinse or tank spray 16, operated by the rinse charge valve 18. The rinsing fluid is introduced during the fluid pressure charging of the system through the fluid pressure inlet 20. Fluid is conducted through the pressure charging conduit 22 to the line 24 to the drain control valve 26, which is preferably a conventional three-way valve. As is shown in FIG. 1, the drain control valve has an open position 28, in which fluid is conducted to conduit 36 to the drain valve 34. The drain control valve also has a closed position 30 in which fluid is conducted to the drain control valve outlet 27 to the tank, for discharging of fluid returning to the drain control valve from the drain valve, as will be explained further hereinafter. A spring 32 operates to bias the drain control valve in an open position, so that when the system is pressurized, introducing fluid into line 24, the fluid is directed to the drain control valve to drain valve 34, to allow draining of the tank.

Figure 2:
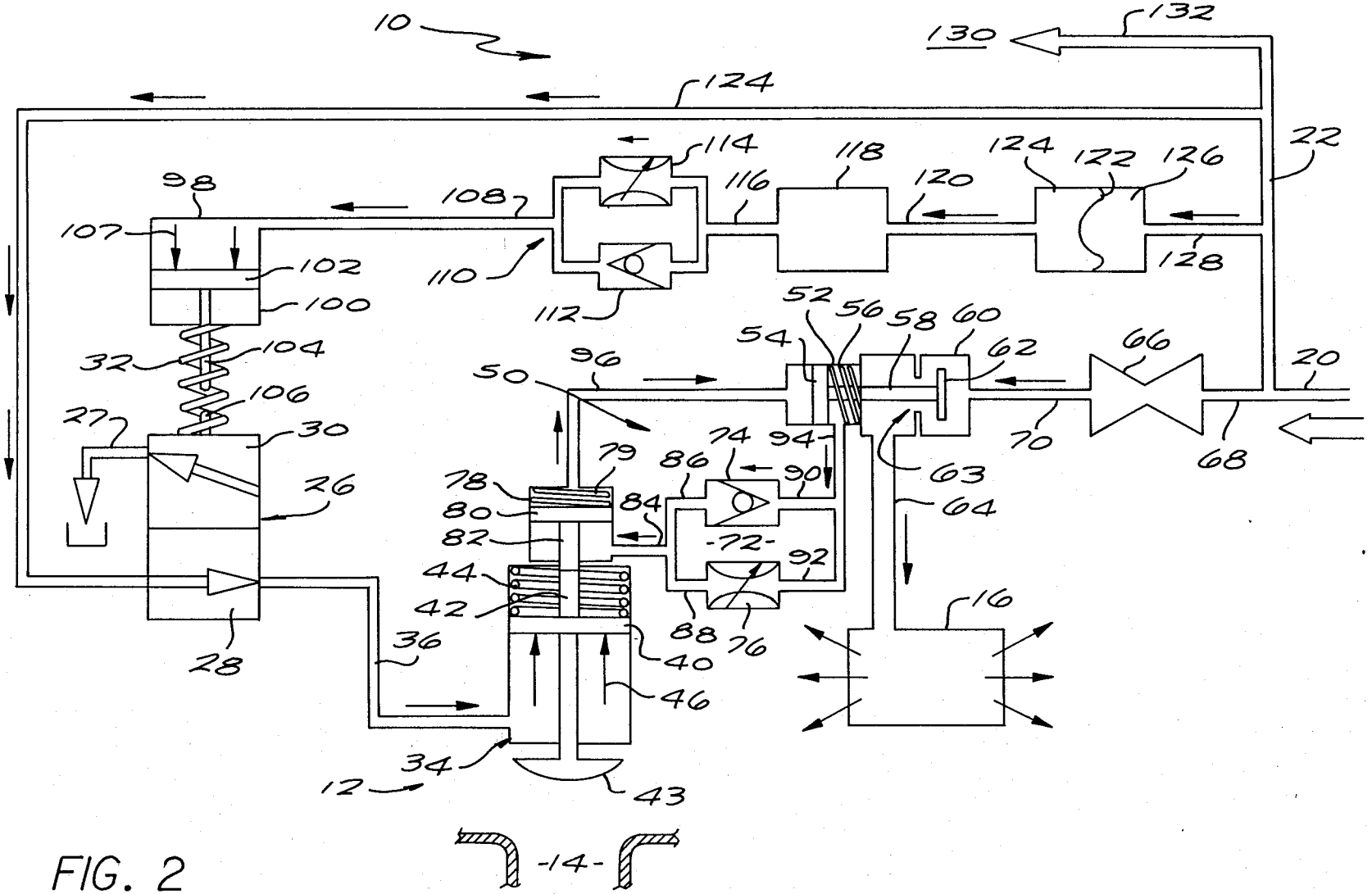
FIG. 2 is a schematic diagram of the valve control apparatus while the tank is rinsing.
Figure 3:
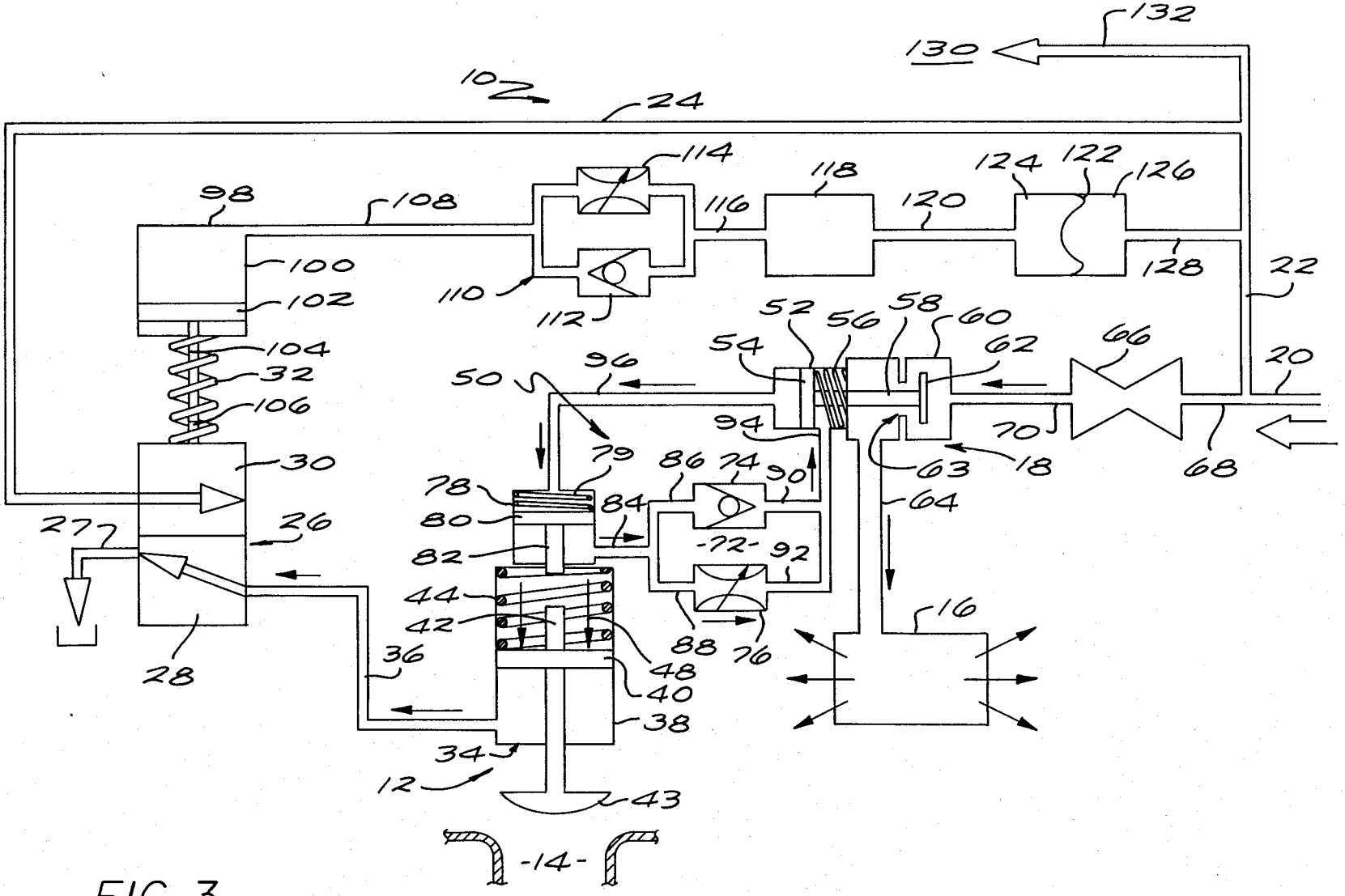
FIG. 3 is a schematic diagram of the valve control apparatus showing the final stage of tank rinse.
Figure 4:
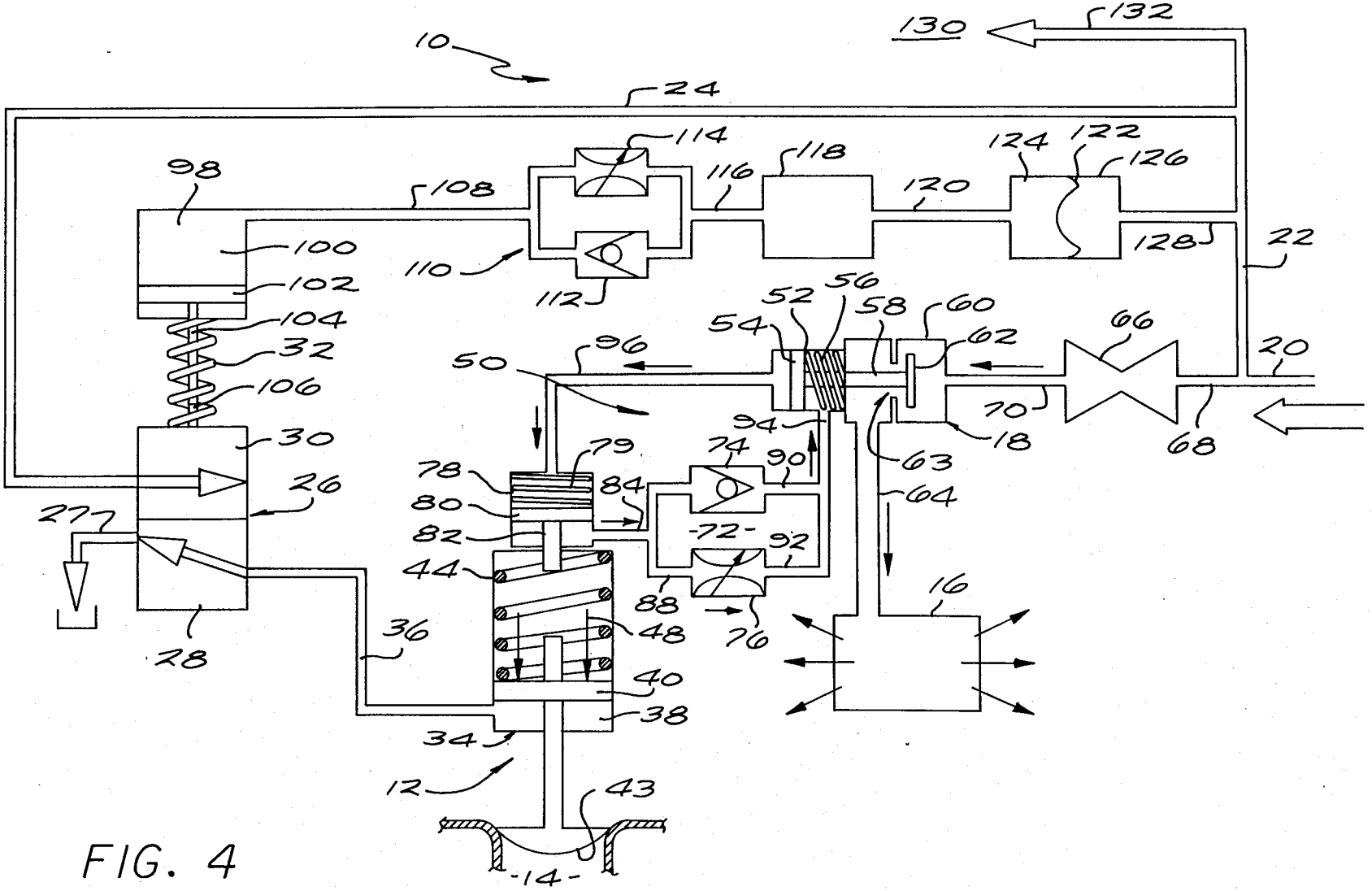
FIG. 4 is a schematic diagram of the valve control apparatus illustrating pre-charging of the system.

Drain valve 34 includes a piston chamber 38 having piston 40 and piston rod 42 connected thereto having a drain seal 43 at one end. As is illustrated in FIGS. 1 and 2, the drain valve has an open position in which the piston is moved in the direction of the arrows 46, and as is shown in FIGS. 3 and 4, the drain valve has a closing position in which the piston is moved in the direction of the arrows 48 to bring the drain seal 43 into sealing engagment with the drain 14. The drain valve is biased to be in the closed position by spring 44, so that when drain control actuator. A flow regulator is provided in sure will return via line 36 from the drain control valve to discharge from the drain control valve outlet 27 into the tank.

A hydraulic rinse control valve 50 is connected to the drain valve so as to be responsive to the opening and closing of the drain valve. The hydraulic rinse valve control circuit includes a rinse valve control piston chamber 52, having a piston 54, a spring 56 biasing the piston 54 in a closed position, such that the piston rod 58 connected to the piston 54, having closure member 62 connected to an end thereof, situated in closure chamber 60, seals the inlet 63 from the closure chamber 60 to the conduit 62 to the tank spray. A flow regulator 66 is placed in the conduit 68 from the pressure charging fluid inlet to rinse charge valve, so that the timing mechanism of the rinse control valve, which will be described further, can accurately govern the amount of fluid admitted to rinse the tank. Fluid enters the closure chamber 60 via conduit 70 from the flow regulator.

The hydraulic timing circuit 72 of the rinse control valve includes a check valve 74 and needle valve 76 connected in parallel to the rinse valve control chamber 52 and to a second piston chamber, timing chamber 78. The timing chamber includes a piston 80, a piston rod 82 connected to the piston, a conduit 84 in fluid communication with the timing chamber which then splits into a conduit 86 connected to the check valve, and a conduit 88 connected to the needle valve. The check valve is connected to conduit 90 in a direction so as to prevent flow from conduit 86 to conduit 90, and the needle valve is further connected by way of conduit 92 to the main conduit 94 to the rinse valve control chamber 52. Conduit 96 makes the hydraulic fluid loop complete, connecting the rinse valve control piston chamber to the timing chamber.

The operation of the hydraulic rinse control valve circuit will now be described. As is illustrated in FIG. 2, when the drain valve opens, the drain valve piston rod 42 is moved so as to contact and press against the timing chamber piston rod 82, forcing fluid in the timing chamber through the conduit 96 to the rinse valve control piston chamber, thereby moving the closure member in the closure chamber away from the inlet in the closure chamber, permitting fluid introduced under pressure from the pressure charging inlet to pass through the flow regulator and the rinse valve, to spray rinse the tank. At this stage, since the drain valve is open, the contents of the waste tank are discharged and rinsing continues, until the rinse control valve operates to again seat the closure member 62 in the closure chamber. While the rinse valve control chamber piston 54 is allowed to move to an open position by flow of fluid through conduit 94, and through the check valve 74 to the timing chamber 78, once the drain valve closes withdrawing the pressure of piston rod 42 from the timing chamber piston rod 82, the piston 80 of the timing chamber is biased by a spring 79 to force fluid to return through needle valve 76, which can be adjusted to allow rinsing to continue for a desired period time following closure of the drain.

Closure of the drain commences with movement of the drain control valve mechanism to a closed position, governed by the drain control valve actuator 98. The drain control valve actuator piston chamber 100 includes the piston 102 having a piston rod 104 extending from the actuator adjacent to and adapted to contact a push rod 106 of the drain control valve. As the actuator piston moves in the direction of the arrows 107 in FIG. 1, the piston rod 104 pressing on the push rod 106 moves the drain control valve into a closed position. The piston 102 of the actuator is caused to move in the direction of the arrows 107 by fluid communicated by conduit 108 from the second hydraulic timing circuit 110 for the actuator. The timing circuit includes a check valve 112 and needle valve 114 connected in parallel between the conduit 108 and the conduit 116 communicating with the pressure reducer 118.

The pressure reducer is provided in line to provide a uniform pressure for the timing circuit. Pressure is typically provided from a pressure charging fluid unit at anywhere from 60 to 100 psi and the pressure reducer 118 reduces the charging pressure to a much lower constant pressure, typically in a range of from 20 to 30 psi. The fluid in the pressure reducer and drain control valve actuator timing circuit 110 is preferably oil, communicated through conduit 120 from a conventional oil/water separator which transfers pressure in the line to the oil 124 from the fluid 126 being charged into the system. The oil/water separator is in communication with the main pressure charging conduit 22 via line 128. Thus, it can readily be seen that the drain control valve actuator and timing circuit for the actuator are in a hydraulic circuit which is isolated from charging fluid, avoiding corrosion of parts in this portion of the circuit and the necessity of adding in line filters to insure accurate functioning of the needle valve and check valve. As is illustrated in FIGS. 1–4, the drain control valve actuator timing circuit operates to provide a steady flow of hydraulic fluid or oil to the drain control actuator to move the piston rod 104 in the direction of arrows 107 to eventually move the drain control valve to its closed position. The timing of the actuator can be controlled by adjustment of the needle valve 114 so that the actuator will close the drain control valve in a desired period of time after the fluid inlet is charged with pressurized fluid, typically from 15 to 30 seconds. The timing of the drain control valve actuator can be adjusted to correlate with the adjustment of the flow regulator which typically allows a flow of five gallons per minute, to allow rinsing of the tank with approximately two and a half gallons over a period of 30 seconds. The timing of the rinse valve control circuit similarly may be adjusted by way of the needle valve 76 so that the rinse charge valve 18 will close in approximately 30 seconds after closing of the drain, to permit pre-charging of the tank with two and a half gallons of fluid, a typical amount of pre-charging fluid.

Figure 5:
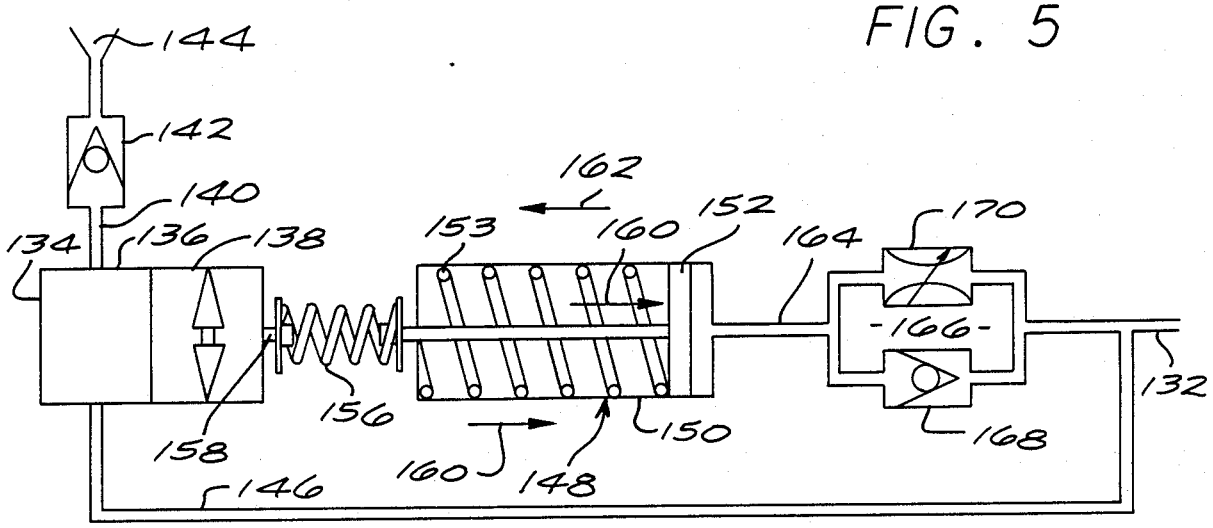
FIG. 5 is a schematic diagram of the anti-siphon circuit in a closed mode before fluid pressure charging of the system.

Since in the design of some aircraft lavatory service systems there is a possibility of siphoning of fluid out of the fluid pressure charging inlet after the fluid charging operation has been completed, an anti-siphon circuit 130 has been provided. This circuit is in communication with the main pressure charging fluid line 22 by way of conduit 132. An air inlet valve 134 is provided to permit the entry of air into the anti-siphon circuit. The air inlet valve has a closed position 136 and an open position 138 as is illustrated in FIG. 5. A conduit 140 is in communication with the inlet valve and includes a check valve in line to prevent escape of fluid from the anti-siphon circuit through the conduit 140 which is open to the atmosphere at the inlet 144. The air inlet valve is in communication with the main charging fluid line by way of conduit 146 which extends to the anti-siphon circuit conduit 132.

Figure 6:
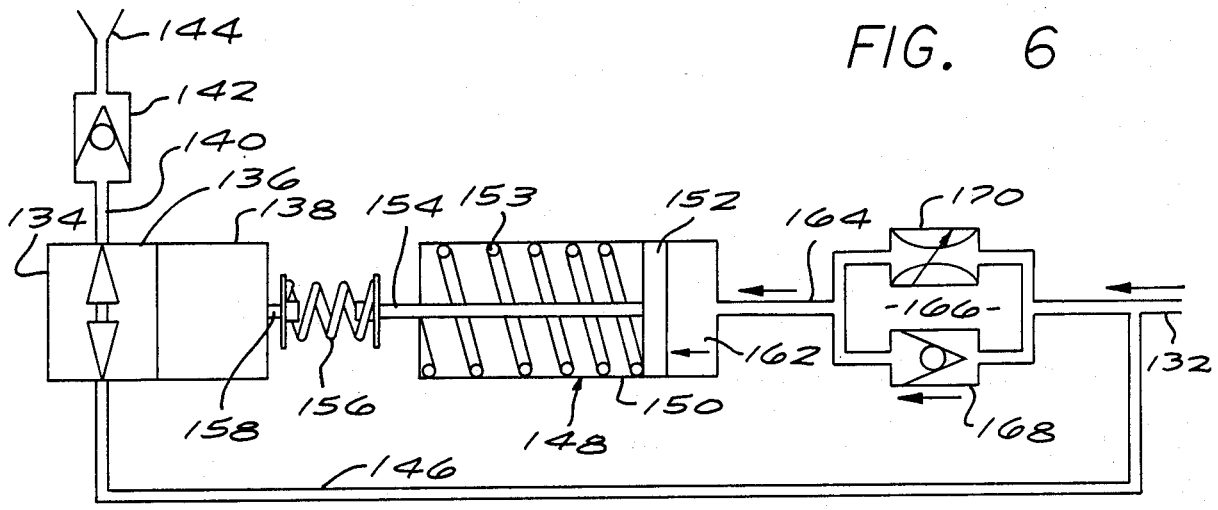
FIG. 6 is a schematic diagram of the anti-siphon circuit during fluid pressure charging of the system.
Figure 7:
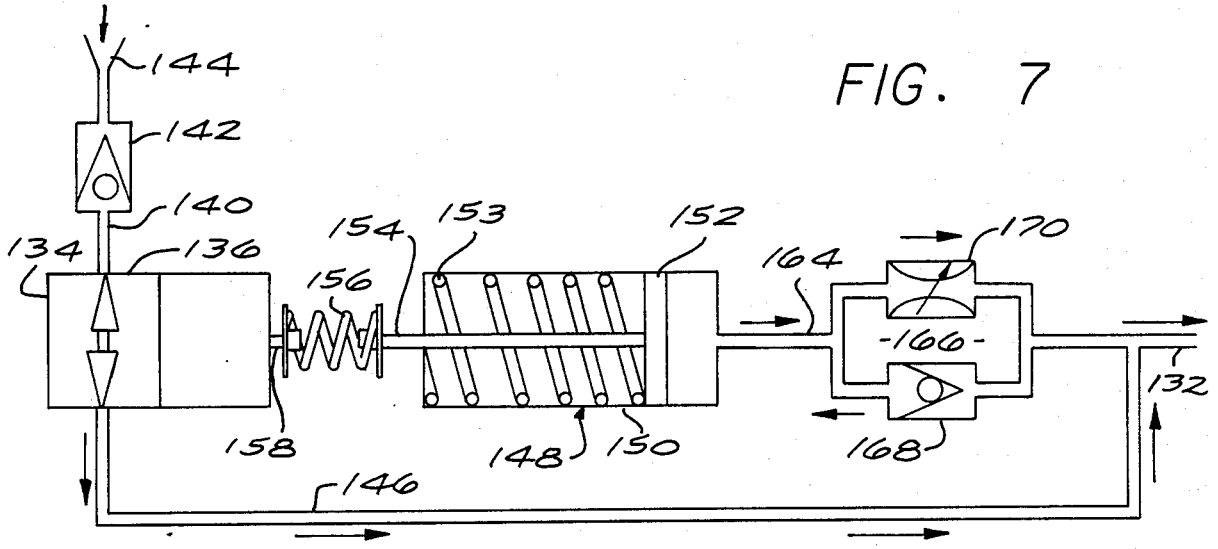
FIG. 7 is a schematic diagram of he anti-siphon circuit in an open mode for introduction of air into the system at the end of a servicing cycle.

Opening and closing of the air inlet valve is controlled by the air inlet valve actuator 148, having a piston chamber 150, piston 152 having a piston rod 154 extending therefrom, a piston spring 153, and a spring 156 connected to the end of the piston rod to the end of a push rod 158 from the air inlet valve, the push rod operating to open and close the air inlet valve. The air inlet valve actuator is biased by piston spring 153 in a first position 160 shown in FIG. 5, in which the air inlet valve is closed. A second position 162 of the air inlet valve actuator is shown in FIG. 6, in which the air inlet valve is moved to an open position. The movement of the air inlet valve actuator piston 152 is governed by fluid communicated to the actuator piston chamber via conduit 164 in fluid communication with a third hydraulic timing circuit 166, which includes a check valve 168 and a needle valve 170, connected in parallel between line 164 and the anti-siphon circuit conduit 132.

The operation of the anti-siphon circuit will now be described. As the hydraulic valve control receives pressurized fluid from the inlet, pressure is communicated to the anti-siphon circuit quickly through check valve 168 to the air inlet valve actuator which operates to open the air inlet valve. While the system is pressurized, fluid communicated through the open air inlet valve does not escape through the air inlet 144 due to the operation of check valve 142. As soon as the valve control apparatus is depressurized by disconnection of the pressure charging equipment, the needle valve 170 of the anti-siphon timing circuit allows for a steady discharge of fluid pressure from the anti-siphon circuit, so that the air inlet valve actuator moves toward the first position, gradually closing the air inlet valve. During this period of time in which the air inlet valve actuator is moving to its first position, fluid pressure in the anti-siphon circuit is negative due to the weight of residual water still in the fill line, check valve 142 opens and gas, preferably air from the aircraft cabin, or alternatively pressurized gas from another source, is permitted to enter through the air inlet 144 through the open air inlet valve. The needle valve of the timing circuit is typically adjusted to allow for closing of the air inlet valve within 15 to 30 seconds following depressurization, to permit air to enter the system during this time. The piston spring 153 serves to bias the air inlet valve actuator towards its first position to force fluid return through the timing circuit, but once the air inlet valve actuator arrives at its first position, compression spring 156 is no longer strong enough to keep the air inlet valve open. The air inlet valve closes, preventing any further entry of air into the system or escape of fluid.

In the foregoing description, it has been demonstrated that the automatic hydraulic valve control apparatus of the present invention will operate to cycle through draining, rinsing and pre-charging without close supervision of technical service personnel. The system also automatically provides for introduction of an amount of air into the pressure charging line to allow draining of the fill line once the system is depressurized.

It is also significant that if the drain control valve becomes inoperative, since the drain control valve default position is the open position, the drain valve will still open under fill line pressure, so that overflowing of the tank is prevented. In addition, the rinse charge valve will allow fluid into the tank only when the drain valve has been opened. If the drain valve is stuck in a closed position, rinsing is prevented, so that overflow of the tank is again avoided. The amount of water or fluid used for rinsing and for pre-charge is held to a consistent desired amount, despite differences in fluid pressures at the fill line, due to the insensitivity of the timing circuits to such changes, by regulation of pressure and flow. In addition, contamination of the hydraulic circuit in the valve control apparatus is prevented by isolation of the hydraulic fluid by use of closed systems, so that the waste tank servicing fluids do not enter the crucial timing control valves.

Although one specific embodiment of the invention has been described and illustrated, it is clear that it is suspectible to numerous modifications and embodiments within the ability of those skilled in the art, and without the exercise of the inventive faculty. Thus, it should be understood that various changes in form, detail and application of the present invention may be made without departing from the spirit and the scope of this invention.

I claim:

1. An automatic hydraulic valve control apparatus for use in combination with a lavatory waste tank for use in a vehicle, the tank having a drain, means for rinsing the tank, a rinse valve for controlling the means for rinsing, a fluid pressure charging inlet for pressurizing and depressurizing said valve control apparatus, the apparatus comprising:

(a) drain valve control means in fluid communication with said pressure charging inlet, having an open position and a closed position, and biased to be in an open position;

(b) drain valve means in fluid communication with said drain valve control means operative to open said drain when fluid pressure is introduced through said pressure charging inlet and said drain valve control means is in the open position, said drain valve means having an open position and a closed position, and biased to be in a closed position;

(c) hydraulic rinse valve control means for opening and closing said rinse valve responsive to said drain valve means so as to open said rinse valve when said drain valve means is in the open position, said rinse valve control means biased to close said rinse valve when said drain valve means is in the closed position, and including hydraulic timing means to delay the closing of said rinse valve a predetermined period of time; and (d) a drain valve control means actuator responsive to fluid pressure from said pressure charging inlet to close said drain valve control means a second predetermined period of time after charging of fluid pressure in said pressure charging inlet.

2. The valve control apparatus of claim 1, further including anti-siphon valve means in fluid communication with said pressure charging inlet by a pressure charging conduit for allowing a predetermined amount of gas to enter said pressure charging conduit following charging of fluid pressure in said pressure charging inlet.

3. The valve control apparatus of claim 2, wherein said anti-siphon valve means includes an air inlet valve having open and closed positions, biased to be in said closed position, and in communication in said open position with an inlet conduit having an inlet open to the atmosphere.

4. The valve control apparatus of claim 3, wherein said air inlet valve includes air inlet valve actuator means having a piston having a first position and a second position, said piston being operatively connected to said air inlet valve and being responsive to fluid pressure from said pressure charging inlet to move into said first position to open said air inlet valve, and including a check valve in said air inlet conduit operative to close said air inlet conduit when said anti-siphon valve is charged with fluid pressure from said pressure charging inlet, said air inlet actuator piston being biased to move to said second position to close said air inlet valve when said anti-siphon valve is not charged with fluid pressure.

5. The valve control means of claim 4, wherein said air inlet valve actuator means includes third hydraulic timing means to delay the air inlet actuator piston moving from said first position to said second position for a predetermined period of time, said air inlet valve remaining in said open position after depressurizing of said anti-siphon valve means during said predetermined time, whereby said check valve is released to open said air inlet valve to the atmosphere until said actuator means has fully moved to said second position, closing said air inlet valve, and whereby said predetermined amount of gas is permitted to enter said pressure charging conduit from the atmosphere.

6. The valve control apparatus of claim 1, wherein said drain valve comprises a piston chamber having an inlet in fluid communication with said drain valve control means, and a piston in said chamber having a piston rod connected thereto, said rinse valve control means including a second piston chamber having a second piston therein and a closed hydraulic fluid loop connected to said second chamber on either side of aid second piston, and said drain valve piston rod operative to move said second piston to a first position in said second piston chamber when said drain valve means is in the open position.

7. The valve control apparatus of claim 6, wherein said rinse valve control means includes a third piston chamber in fluid communication with said closed hydraulic fluid loop and having a piston therein having a piston rod operative to open and close said rinse valve.

8. The valve control apparatus of claim 7, wherein said hydraulic timing means comprises a check valve and a needle valve connected in parallel in said fluid loop.

9. The valve control apparatus of claim 1, including a flow regulator connecting said fluid inlet to said rinse valve.

10. The valve control apparatus of claim 1 wherein said drain valve control means actuator includes a second hydraulic timing means to delay the closing of said drain valve control means said second predetermined period of time.

11. The valve control apparatus of claim 10 wherein said second hydraulic timing means comprises a check valve and needle valve connected in parallel in a closed hydraulic fluid circuit in said drain valve control means actuator.

12. The valve control apparatus of claim 11, wherein said fluid circuit includes fluid separation means for transmitting pressure from said fluid inlet to hydraulic fluid in said circuit to said second hydraulic timing means.

13. The valve control apparatus of claim 12, wherein said fluid circuit includes a pressure reducer between said separation means and said second hydraulic timing means.

* * * * *

UNITED STATES PATENT AND TRADEMARK OFFICE

CERTIFICATE OF CORRECTION

PATENT NO. : 4,882,792

DATED : November 28, 1989

INVENTOR(S) : Ray T. Vincent

It is certified that error appears in the above-identified patent and that said Letters Patent is hereby corrected as shown below:

Column 4, lines 63 and 64, delete "actuator. A flow regulator is provided in sure" and substitute therefor --valve 26 is in a closed position, fluid pressure--;

Column 9, line 24, delete "aid" and substitute therefore "said".

Signed and Sealed this

Ninth Day of October, 1990

*Attest:*

*Attesting Officer*

HARRY F. MANBECK, JR.

*Commissioner of Patents and Trademarks*